US009303872B2

(12) United States Patent
Hadley et al.

(10) Patent No.: US 9,303,872 B2
(45) Date of Patent: Apr. 5, 2016

(54) FUEL INJECTOR

(75) Inventors: Mark Allan Hadley, Greer, SC (US); Jun Cai, Greenville, SC (US); Lucas John Stoia, Taylors, SC (US); Geoffrey David Myers, Simpsonville, SC (US); Jayaprakash Natarajan, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1231 days.

(21) Appl. No.: 13/233,127

(22) Filed: Sep. 15, 2011

(65) Prior Publication Data

US 2013/0067921 A1 Mar. 21, 2013

(51) Int. Cl.
*F23R 3/20* (2006.01)
*F23R 3/34* (2006.01)

(52) U.S. Cl.
CPC . *F23R 3/20* (2013.01); *F23R 3/346* (2013.01); *F23R 2900/03341* (2013.01)

(58) Field of Classification Search
CPC ..... F23R 3/20; F23R 3/34; F23R 3/346; F23R 2900/00341
USPC ..... 60/737, 740, 746
See application file for complete search history.

(56) References Cited

U.S. PATENT DOCUMENTS

| | | | | |
|---|---|---|---|---|
| 3,516,290 | A | 6/1970 | Matteucci | |
| 6,047,550 | A | 4/2000 | Beebe | |
| 6,192,688 | B1 | 2/2001 | Beebe | |
| 6,868,676 | B1 | 3/2005 | Haynes | |
| 8,601,820 | B2 * | 12/2013 | Byrne et al. | 60/754 |
| 8,701,382 | B2 | 4/2014 | Davis, Jr. et al. | |
| 8,701,383 | B2 | 4/2014 | Venkataraman et al. | |
| 8,919,137 | B2 * | 12/2014 | DiCintio et al. | 60/737 |
| 9,010,120 | B2 * | 4/2015 | DiCintio et al. | 60/746 |
| 2009/0277178 | A1 * | 11/2009 | Carroni et al. | 60/742 |
| 2010/0174466 | A1 | 7/2010 | Davis, Jr. et al. | |
| 2010/0229557 | A1 * | 9/2010 | Matsumoto et al. | 60/737 |

(Continued)

FOREIGN PATENT DOCUMENTS

| | | | |
|---|---|---|---|
| CN | 101776014 | A | 7/2010 |
| CN | 101776017 | A | 7/2010 |
| EP | 1619377 | A1 | 1/2006 |

(Continued)

OTHER PUBLICATIONS

Search Report and Written Opinion from EP Application No. 12176013.6 dated Jan. 2, 2013.

(Continued)

*Primary Examiner* — J. Gregory Pickett
(74) *Attorney, Agent, or Firm* — Dority & Manning, PA

(57) ABSTRACT

A fuel injector is provided and includes a member defining a flowpath through which a first fluid flows, the flowpath having a cross-section with transverse elongate and short axes, a head defining a plenum storing a supply of a second fluid and a system fluidly coupled to the flowpath and the plenum to inject the second fluid from the plenum and into the flowpath at first and second locations along the elongate axis. The injected second fluid is formed into jets at the first and second locations, the first fluid entrains the jets such that the injected second fluid flows through the flowpath and mixes with the first fluid, and the short axis has a sufficient dimension such that the jets remain spaced from a sidewall of the member.

18 Claims, 4 Drawing Sheets

(56) References Cited

U.S. PATENT DOCUMENTS

2012/0297783 A1* 11/2012 Melton et al. ..... 60/740
2013/0174558 A1* 7/2013 Stryapunin ..... 60/734

FOREIGN PATENT DOCUMENTS

EP 2116768 A1 11/2009
WO 2009038652 A2 3/2009

OTHER PUBLICATIONS

Unofficial English Translation of Chinese Office Action issued in connection with corresponding CN Application No. 201210244763.1 on Jul. 3, 2015.

* cited by examiner

FUEL INJECTOR

BACKGROUND OF THE INVENTION

The subject matter disclosed herein relates to a fuel injector and, more particularly, to a fuel injector for a staged combustion process.

In gas turbine engines, combustible materials are combusted in a combustor and the high energy fluids produced by the combustion are directed to a turbine via a transition piece. In the turbine, the high energy fluids aerodynamically interact with and drive rotation of turbine blades in order to generate electricity. The high energy fluids are then transmitted to further power generation systems or exhausted as emissions along with certain pollutants, such as oxides of nitrogen (NOx) and carbon monoxide (CO). These pollutants are produced due to non-ideal consumption of the combustible materials.

Recently, efforts have been undertaken to achieve more ideal consumption of the combustible materials to thereby reduce the amounts of pollutants in the emissions. These efforts include the development of fuel injection whereby combustible materials are injected into the transition piece to mix with the main flow of high energy fluid moving through the transition piece toward the turbine. This leads to increased temperature and energy of the high energy fluids and more ideal consumption of fuel, which correspondingly reduces the pollutant emissions.

BRIEF DESCRIPTION OF THE INVENTION

According to one aspect of the invention, a fuel injector is provided and includes a member defining a flowpath through which a first fluid flows, the flowpath having a cross-section with transverse elongate and short axes, a head defining a plenum storing a supply of a second fluid and a system fluidly coupled to the flowpath and the plenum to inject the second fluid from the plenum and into the flowpath at first and second locations along the elongate axis. The injected second fluid is formed into jets at the first and second locations, the first fluid entrains the jets such that the injected second fluid flows through the flowpath and mixes with the first fluid, and the short axis has a sufficient dimension such that the jets remain spaced from a sidewall of the member According to another aspect of the invention, a portion of a gas turbine engine is provided and includes a vessel including a liner defining an interior through which a main flow travels and a flow sleeve disposed about the liner to define a space through which a liner flow travels and a fuel injector to injector fuel and air into the main flow. The fuel injector includes a member traversing the space and defining an elongate flowpath through which the fuel and air flow toward the main flow. The member includes an outer surface having an elongate shape and is disposed in the space at an angle with respect to the liner flow.

According to yet another aspect of the invention, a portion of a gas turbine engine is provided and includes a vessel including a liner defining an interior through which a main flow travels and a flow sleeve disposed about the liner to define a space through which a liner flow travels and a fuel injector. The fuel injector includes a member traversing the space and defining a flowpath through which a first fluid flows, the flowpath having a cross-section with transverse elongate and short axes, the elongate axis being angled with respect to the liner flow, a head defining a plenum storing a supply of a second fluid and a system fluidly coupled to the flowpath and the plenum to inject the second fluid from the plenum and into the flowpath at first and second locations along the elongate axis. The injected second fluid is formed into jets at the first and second locations, the first fluid entrains the jets such that the injected second fluid flows through the flowpath toward the main flow and mixes with the first fluid, and the short axis has a sufficient dimension such that the jets remain spaced from a sidewall of the member.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
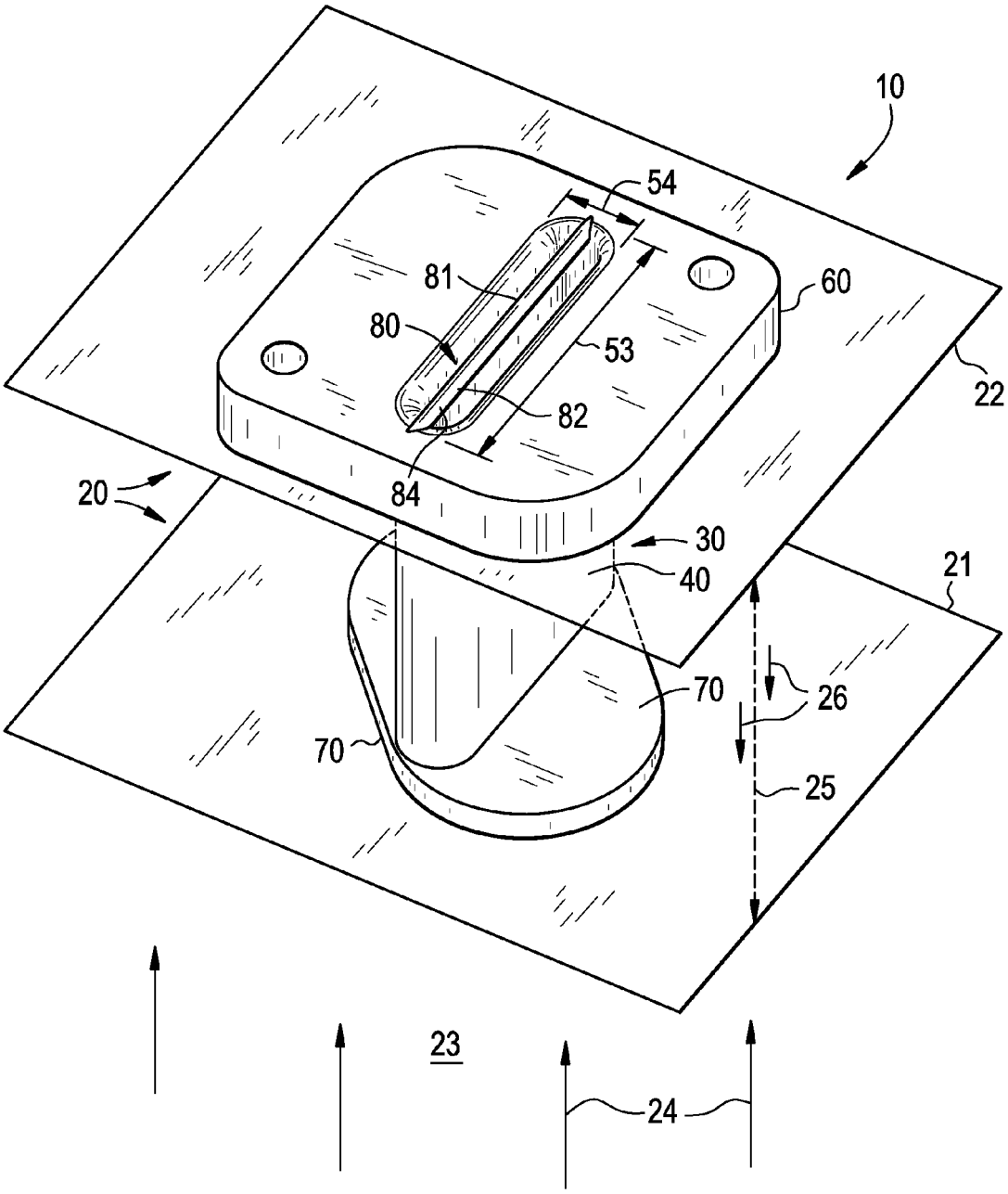
FIG. 1 is a perspective view of a fuel injector.
Figure 2:
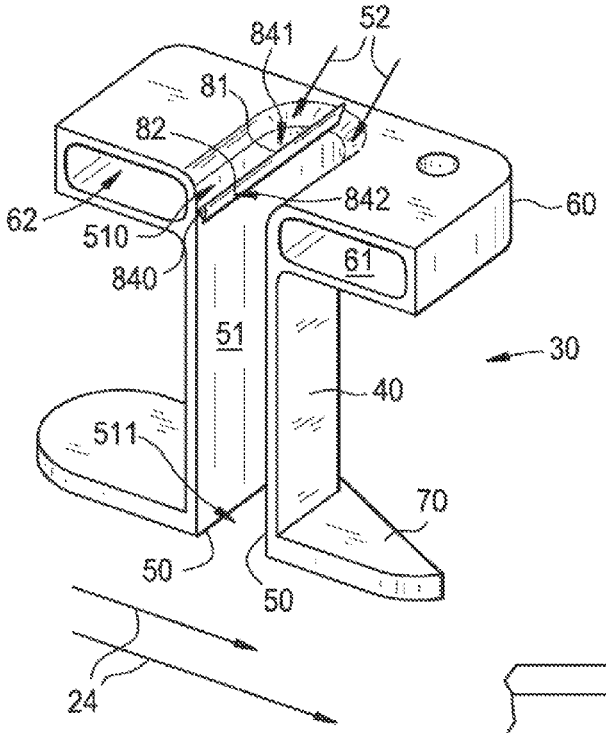
FIG. 2 is a cutaway view of the fuel injector of FIG. 1.

With reference to FIGS. 1 and 2, a portion of a gas turbine engine 10 is provided and includes a vessel, such as for example, a transition piece 20 and a fuel injector 30. The transition piece 20 includes a transition piece body such as a liner 21. The liner 21 is formed to define an interior 23. A main flow 24 of high energy fluid is produced by combustion in a combustor and travels from the combustor, which is operably disposed upstream from the transition piece 20, through the interior 23 to a turbine operably disposed downstream from the transition piece 20. A flow sleeve 22, which can be referred to as an impingement sleeve, may in some embodiments surround the liner 21 to form an annular space 25 about the liner 21 through which a liner flow 26, such as compressor discharge casing (CDC) air, flows in an upstream direction toward a head end of the combustor. The liner flow 26 and the main flow 24 may propagate in substantially opposite directions.

The fuel injector 30 includes a member 40 disposed to traverse the annular space 25 in a substantially radial direction. The member 40 includes a sidewall 50. The sidewall 50 defines a flowpath 51 through which a first fluid 52, such as air or CDC air, flows in the radial direction. The flowpath 51 has an elongate cross-sectional shape that is characterized with an elongate axis 53, which may be oriented transversely with respect to the liner flow 26, and a short axis 54, which is shorter than and oriented transversely with respect to the elongate axis 53. The elongate axis 53 may form an angle of 0 degrees or 90 degrees with a predominant travel direction of the liner flow 26 or, in accordance with further embodiments, the elongate axis 53 may form an angle between 0 and 90 degrees with the predominant travel direction of the liner flow 26. The elongate cross-sectional shape of the flowpath 51 may be an elliptical shape, a rectangular shape, a super-elliptical shape or another similar shape with possibly aerodynamic edges.

The fuel injector 30 is disposed such that an inlet 510 of the flowpath 51 is proximate to the flow sleeve 22 and an outlet 511 is proximate to the liner 21 whereby the first fluid 52 enters the flowpath 51 at the inlet 510 and flows toward the outlet 511 and then into the main flow 24. The fuel injector 30 may further include a head 60 and a foot 70. The head 60 is connected to the member 40 proximate to the inlet 510 and may be supportively coupled to the flow sleeve 22 or integrally formed with the flow sleeve 22. The head 60 is formed to define a plenum 61 therein, which is configured to store or to be supplied with a supply of a second fluid 62, such as fuel or late lean injection (LLI) fuel. The foot 70 is connected to the member 40 proximate to the outlet 511 and may be supportively coupled to the liner 21 or integrally formed with the liner 21. In particular, the liner 21 may be formed to define an aperture having a shape corresponding to a shape of the foot 70 whereby the foot 70 is installed into the aperture with little to no clearance. In accordance with embodiments, the foot 70 may be dropped in and welded to the liner 21 at the aperture and/or a seal may be provided between the liner 21 and the foot 70.

The fuel injector 30 further includes an injection system 80. The injection system 80 is disposed at or proximate to the inlet 510 of the flowpath 51 and fluidly coupled to the plenum 61. The injection system 80 is thereby configured to inject the second fluid 62 from the plenum 61 and into the flowpath 51. This injection may occur at least at first and second injection locations 81 and 82, which are arrayed with respect to one another in a direction extending along the elongate axis 53. Upon injection, the injected second fluid 62 is formed, due to a pressure thereof and the influence of the first fluid 52, into jets at the first and second locations 81 and 82. The first fluid 52 entrains these jets such that the injected second fluid 62 flows through the flowpath 51 toward the main flow 24 while mixing with the first fluid 52. The distance between the first and second locations 81 and 82 is sufficient to prevent the jets from interfering with each other and.

Figure 3:
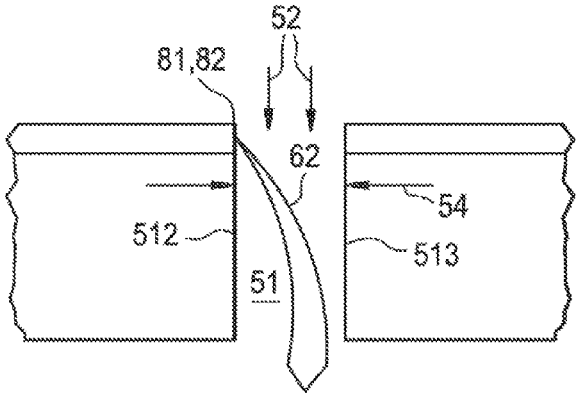
FIG. 3 is a circumferential view of a fuel injector.
Figure 4:
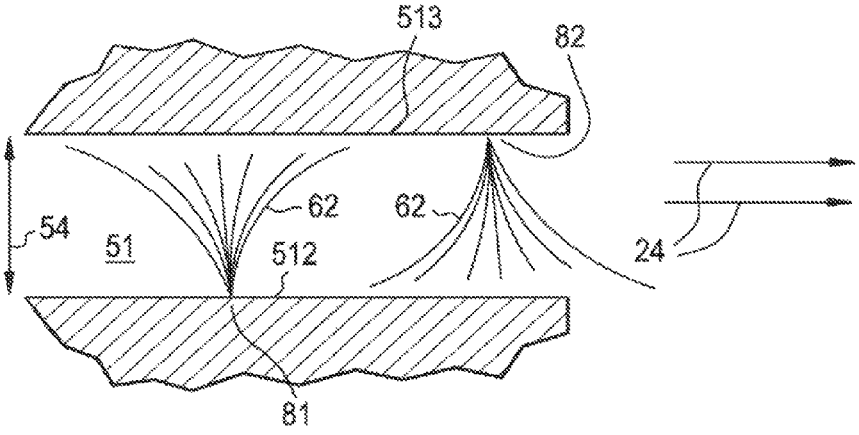
FIG. 4 is a radial view of the fuel injector of FIG. 3.
Figure 5:
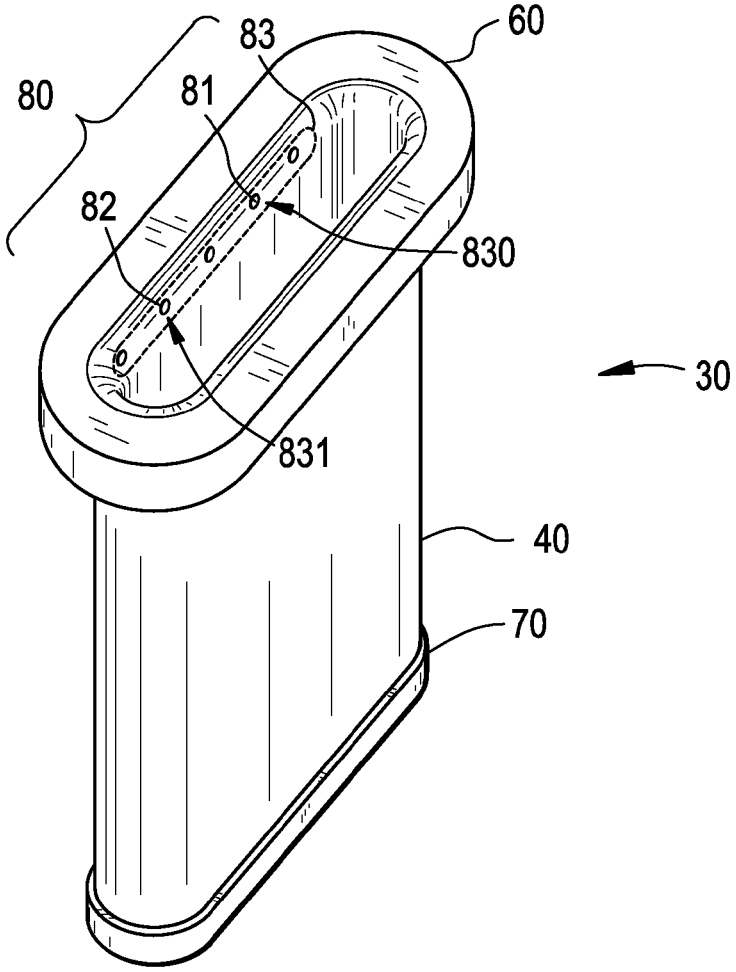
FIG. 5 is a perspective view of a fuel injector according to alternative embodiments.

With reference to FIGS. 3 and 4, the short axis 54 is configured with a sufficient dimension such that the jets remain spaced from an interior facing surface of the sidewall 50 of the member 40. As shown, if the second fluid 62 is injected into the flowpath 51 proximate to a centerline of the inlet 510 (as illustrated in FIGS. 1 and 2), the jets have sufficient momentum to propagate toward a side 512 or 513 of the flowpath 51 while being entrained to flow toward the main flow 24 by the first fluid 52. The width of the short axis 54 is sufficient to prevent the jets from reaching the sides 512 or 513 before reaching the main flow 24. Similarly, if the second fluid 62 is injected into the flowpath 51 proximate to a side 512 of the flowpath 51 (as illustrated in FIG. 5), the jets have sufficient momentum to propagate toward the opposite side 513 while being entrained to flow toward the main flow 24 by the first fluid 52. The width of the short axis 54 is again sufficient to prevent the jets from reaching the opposite side 513 before reaching the main flow 24.

Thus, the first and second fluids 52 and 62 may be injected into the main flow 24 at the axial location of the fuel injector 30, which may be downstream from the combustor of a gas turbine engine. In such a case, the injection of the first and second fluids 52 and 62 forms a secondary stage of combustion that will tend to increase an energy of the main flow 24 and reduce emissions of pollutants, such as oxides of nitrogen (NOx).

Referring to FIG. 5, the injection system 80 may include a portion 83 at one or both of the forward and aft sides of the sidewall 50. The portion 83 is formed to define at least first and second through-holes 830 and 831 at least at the first and second locations 81 and 82, respectively, and in more or less numbers as shown in FIG. 5. The second fluid 62 is injected into the flowpath 51 by way of the first and second through-holes 830 and 831 and the size, pressure, reach and overall shape of the jets formed thereby can be dictated by varying at least the size and shape of the first and second through-holes 830 and 831. The first and second through-holes 830 and 831 may be defined on one or both opposite sides 512 and 513 of the flowpath 51. Where the first and second through-holes 830 and 831 are defined on the opposite sides 512 and 513, they may be staggered at the first and second locations 81 and 82, respectively, in order to avoid interference.

Figure 6:
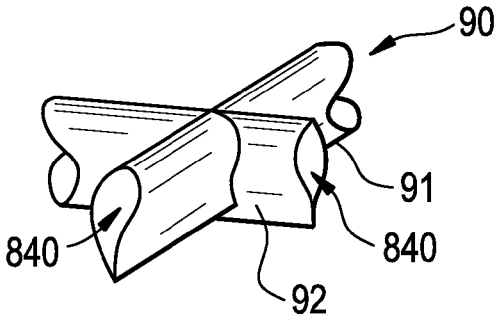
FIG. 6 is a perspective view of a blade matrix.

With reference back to FIGS. 1 and 2, the injection system 80 may include a blade 84, which is supported by the head 60, and which is formed to define a blade interior 840. The blade interior 840 is fluidly communicative with the plenum 61. The blade 84 may be further formed to define first and second injection-holes 841 and 842 at the first and second locations 81 and 82, respectively. The second fluid 62 is injected into the flowpath 51 by way of the first and second injection-holes 841 and 842 and the size, pressure, reach and overall shape of the jets can be dictated by varying at least the size and shape of the first and second injection-holes 841 and 842. As shown in FIG. 2, the first and second injection-holes 841 and 842 may be defined on one or both opposite sides of the blade 84 and the blade 84 may have an airfoil shape. With reference to FIG. 6, the blade 84 may be formed as a blade matrix 90 including a central blade 91 and one or more auxiliary blades 92 that are oriented transversely with respect to the central blade 91.

Figure 7:
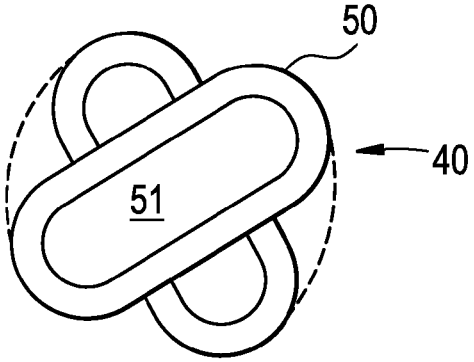
FIG. 7 is a schematic radial view of a fuel injector.
Figure 8:
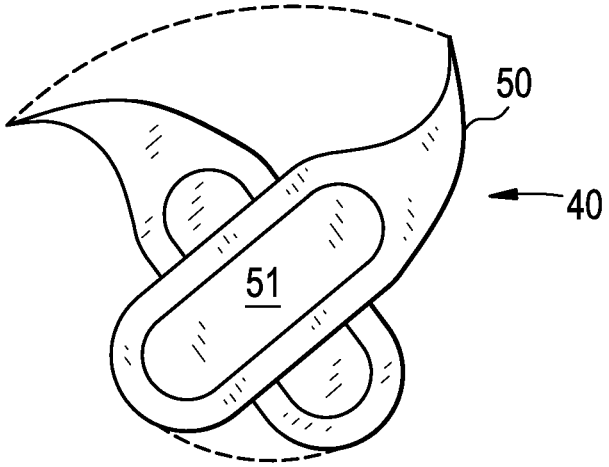
FIG. 8 is a schematic radial view of a fuel injector.

With reference to FIGS. 7 and 8, an outer surface of the sidewall 50 of the member 40 may have a shape, which is similar to or different from that of the flowpath 51. That is, as shown in FIG. 7, the flowpath 51 may have a cross-sectional rectangular shape with rounded corners and the outer surface of the sidewall 50 may also have a cross-sectional rectangular shape with rounded corners. By contrast, as shown in FIG. 8, the flowpath 51 may have a cross-sectional rectangular shape with rounded corners whereas the outer surface of the sidewall 50 may have, for example, a cross-sectional airfoil shape. In either case, as shown in FIGS. 7 and 8, the member 40 may have an evolving shape along a longitudinal axis thereof. That is, the member 40 may be twisted, curved or variably shaped along the longitudinal axis from the head 60 to the foot 70.

Figure 9:
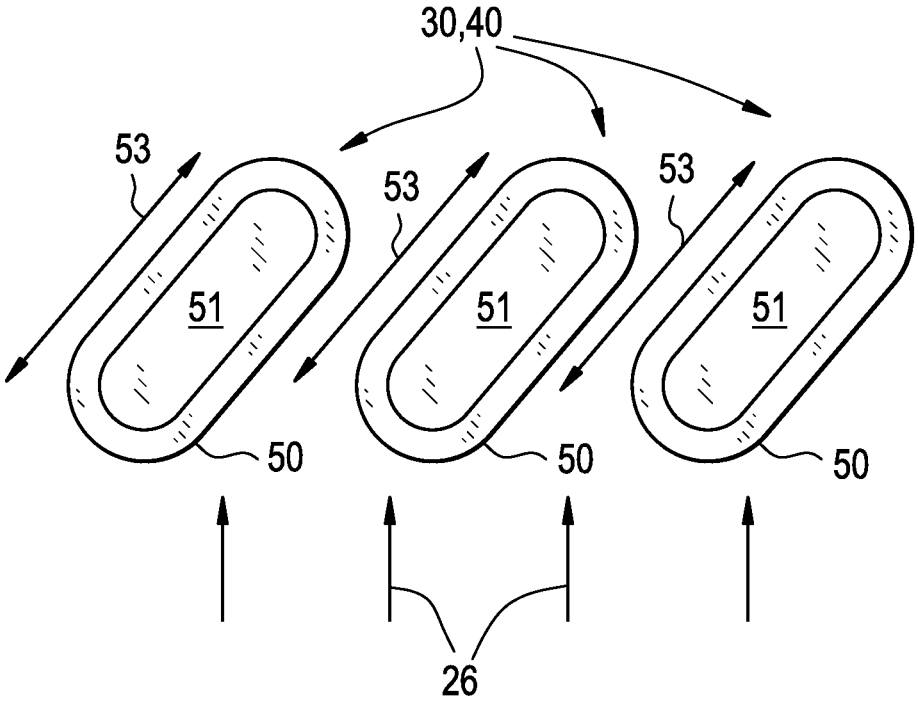
FIG. 9 is a schematic radial view of plural fuel injectors.

With reference to FIG. 9, the fuel injector 30 may be plural in number with the plural fuel injectors 30 arrayed circumferentially about the main flow 24. In this case, the members 40 of each of the plural fuel injectors 30 may be substantially parallel with one another relative to the main flow 24. That is, the members 40 of each of the plural fuel injectors 30 may have an elongate axis 53 that is similarly angled with respect to the predominant travel direction of the liner flow 26. In accordance with alternate embodiments, however, it is to be understood that one or more of the members 40 may be arrayed such that the respective elongate axis 53 forms a different angle with respect to the predominant travel direction of the liner flow 26.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injector, comprising:

a member defining a flowpath through which a first fluid flows, the flowpath having a cross-section with transverse elongate and short axes, wherein the member is disposed in a space between a liner and a flow sleeve disposed about the liner through which a liner flow travels such that the elongate and short axes are disposed at complementary angles that are each between 0 and 90 degrees with respect to the liner flow;

a head defining a plenum storing a supply of a second fluid; and a system fluidly coupled to the flowpath and the plenum to inject the second fluid from the plenum at injection locations defined in the member about a periphery of the flowpath at first and second locations along the elongate axis and into the flowpath, the injected second fluid being formed into jets at the first and second locations, the first fluid entraining the jets such that the injected second fluid flows through the flowpath and mixes with the first fluid, and the short axis having a sufficient dimension such that the jets remain spaced from a sidewall of the member.

2. The fuel injector according to claim 1, wherein the first fluid comprises air and the second fluid comprises fuel.

3. A fuel injector, comprising:

a member defining a flowpath through which a first fluid flows, the flowpath having a cross-section with transverse elongate and short axes, wherein the member is disposed in a space between a loner and a flow sleeve disposed about the liner through which a liner flow travels such that the elongate and short axes are disposed at complementary angles that are each between 0 and 90 degrees with respect to the liner flow;

a head defining a plenum storing a supply of a second fluid; and a system fluidly coupled to the flowpath and the plenum to inject the second fluid from the plenum and into the plenum at first and second locations along the elongate axis, the injected second fluid being formed into jets at the first and second locations, the first fluid entraining the jets such that the injected second fluid flows through the flowpath and mixes with the first fluid, and the short axis having a sufficient dimension such that the jets remain spaced from a sidewall of the member, wherein the system comprises a portion of the sidewall of the member defining first and second through-holes at the first and second locations, respectively through which the second fluid is injected into the flowpath.

4. The fuel injector according to claim 3, wherein the first and second through-holes are defined on one or both sides of the flowpath.

5. The fuel injector according to claim 1, wherein the system comprises a blade supported by the head, the blade defining:

a blade interior, which is fluidly communicative with the plenum, and first and second injection-holes at the first and second locations, respectively, through which the second fluid is injected into the flowpath.

6. The fuel injector according to claim 5, wherein the first and second injection-holes are defined on one or both sides of the blade.

7. The fuel injector according to claim 5, wherein the blade has an airfoil shape.

8. The fuel injector according to claim 5, wherein the blade comprises a blade matrix including transverse central and auxiliary blades.

9. The fuel injector according to claim 1, wherein an outer surface of the member has a shape similar to that of the flowpath.

10. The fuel injector according to claim 1, wherein an outer surface of the member has a shape different from that of the flowpath.

11. The fuel injector according to claim 10, wherein the outer surface of the member has an airfoil shape.

12. The fuel injector according to claim 1, wherein the member has an evolving shape along a longitudinal axis thereof.

13. A portion of a gas turbine engine, comprising:

a vessel including a liner defining an interior through which a main flow travels and a flow sleeve disposed about the liner to define a space through which a liner flow travels; and a fuel injector to injector fuel and air into the main flow, the fuel injector including a member traversing the space and defining an elongate flowpath through which the fuel and air flow toward the main flow, the elongate flowpath having a cross-section defined in parallel with a direction of flow of the loner flow through the space with transverse elongate and short axes, the member including an outer surface having an elongate shape, wherein the member is disposed in the space such that the elongate and short axes are disposed at complementary angles that are each between 0 and 90 degrees with respect to the liner flow.

14. The portion of the gas turbine engine according to claim 13, wherein the fuel injector is plural in number, the plural fuel injectors being arrayed circumferentially about the main flow.

15. The portion of the gas turbine engine according to claim 14, wherein each member of each of the plural fuel injectors is similarly angled with respect to the liner flow.

16. The portion of the gas turbine engine according to claim 13, wherein the flowpath and the member have similar shapes.

17. A portion of a gas turbine engine, comprising:

a vessel including a liner defining an interior through which a main flow travels and a flow sleeve disposed about the liner to define a space through which a liner flow travels; and a fuel injector, including:

a member traversing the space and defining a flowpath through which a first fluid flows, the flowpath having a cross-section with transverse elongate and short axes, wherein the member is disposed in the space such that the elongate and short axes are disposed at complementary angles that are each between 0 and 90 degrees with respect to the liner flow;

a head defining a plenum storing a supply of a second fluid; and a system fluidly coupled to the flowpath and the plenum to inject the second fluid from the plenum and into the flowpath at first and second locations along the elongate axis, the injected second fluid being formed into jets at the first and second locations, the first fluid entraining the jets such that the injected second fluid flows through the flowpath toward the main flow and mixes with the first fluid, and the short axis having a sufficient dimension such that the jets remain spaced from a sidewall of the member.

18. The portion of the gas turbine engine according to claim 17, further comprising a foot of the member, the head being supportively coupled to or integrally formed with the flow sleeve and the foot being supportively coupled to or integrally formed with the liner.

* * * * *